United States Patent [19]

Chapman

[11] 4,177,583

[45] Dec. 11, 1979

[54] ORTHOPEDIC SHOE WITH FOREFOOT PROTECTIVE GUARD

[76] Inventor: Andrew W. Chapman, 5711 Woodland Dr., Western Springs, Ill. 60558

[21] Appl. No.: 895,959

[22] Filed: Apr. 13, 1978

[51] Int. Cl.[2] ..... A43C 13/14; A43B 7/00

[52] U.S. Cl. ..... 36/77 R; 36/72 R; 36/110; 128/83.5

[58] Field of Search ..... 36/7.4, 7.5, 1, 72, 36/77 R, 106, 77 M, 110, 96; 128/82, 83, 83.5

[56] References Cited

U.S. PATENT DOCUMENTS

| | | | |
|---|---|---|---|
| 2,292,297 | 8/1942 | Sherlock | 36/1 |
| 3,040,455 | 6/1962 | Criswell | 36/72 R |
| 3,263,679 | 8/1966 | Hass | 128/83.5 |
| 3,661,151 | 5/1972 | Schoenbrun et al. | 128/83.5 |
| 3,716,932 | 2/1973 | Pakulak | 36/72 R |
| 4,061,138 | 12/1977 | Bernstein | 128/82 |

FOREIGN PATENT DOCUMENTS

| | | | |
|---|---|---|---|
| 1220846 | 1/1971 | United Kingdom | 36/72 R |

*Primary Examiner*—James Kee Chi

*Attorney, Agent, or Firm*—Hill, Van Santen, Steadman, Chiara & Simpson

[57] ABSTRACT

An orthopedic shoe with a domical forefoot protective guard to provide a safety zone for the distal portion of the foot. The shoe includes a generally rigid sole, to which the protective guard is attached and which extends about and overlies the dorsum of the toes. Spacer means may be utilized to provide additional forward clearances as may be required in certain deformity corrective surgical procedures.

10 Claims, 9 Drawing Figures

Fig. 6
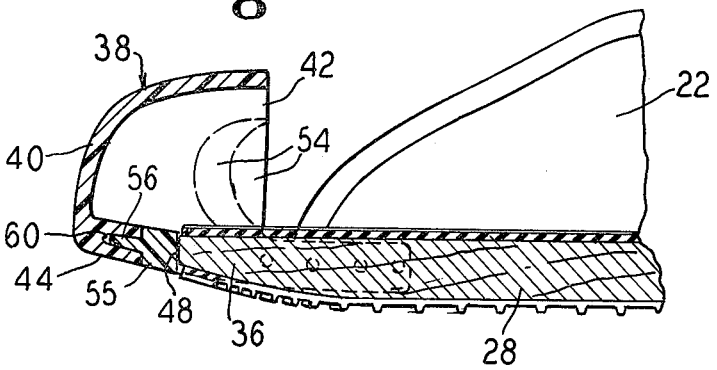
Fig. 7
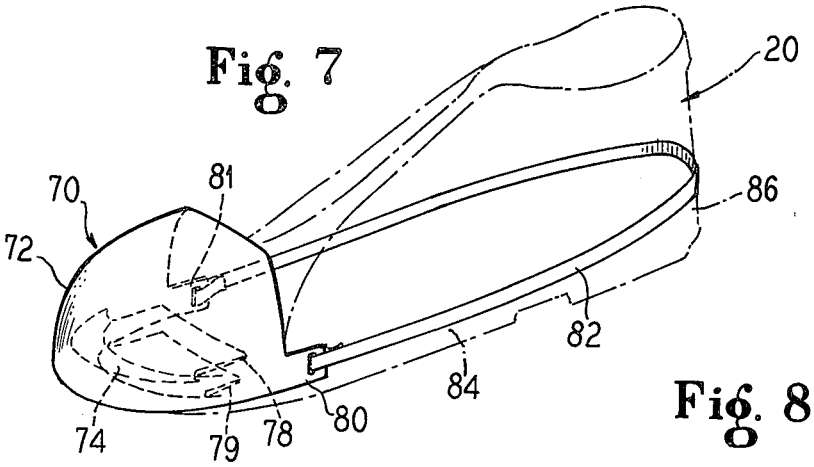
Fig. 8
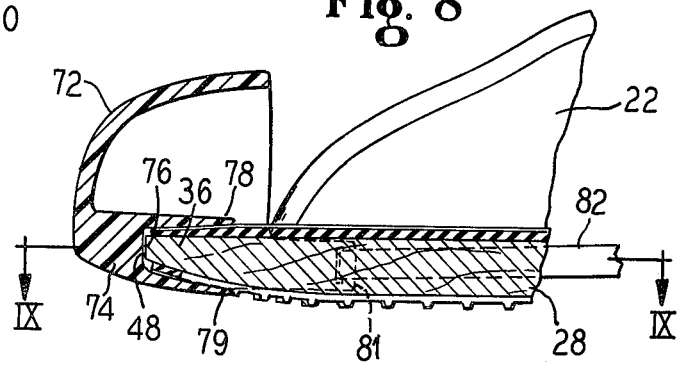
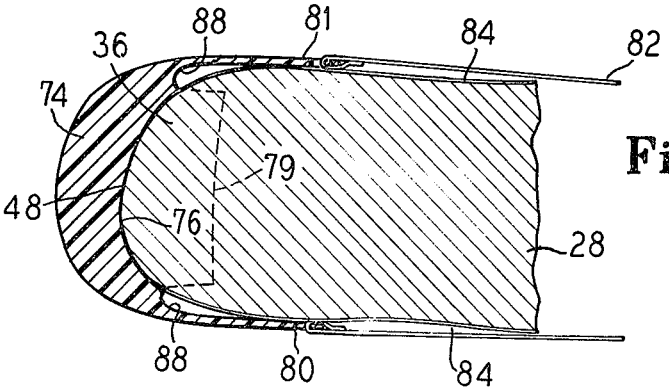
Fig. 9

ORTHOPEDIC SHOE WITH FOREFOOT PROTECTIVE GUARD

BACKGROUND OF THE INVENTION

Postoperative care of the foot following orthopedic surgery generally requires that a patient wear special orthopedic shoes which somewhat immobilizes the foot and/or provides suitable clearances of the affected areas until edema and inflammatory process subsides to avoid abuse of tissues which delays healing. Prior to the availability of said orthopedic shoes, cutout street shoes were utilized which generally afforded inadequate protection and frequently encouraged paresthesia to develop. Heretofore, orthopedic shoes available to patients recovering from surgery of the forefoot, i.e. the toes or metatarsophalangeal region provided a loose fitting rigid soled shoe with openings therein to avoid contact with the sensitive areas. However, following correction measures to the forefoot, as for example avulsion of the nail; hypertrophy of the nail lip; and occlusion of the nail groove; as well as numerous surgical procedures involving the toes, this area becomes extremely sensitive to the touch and coupled with the somewhat encumbered walking abilities of the patient at this time there is an exceedingly great risk of bumping this portion of the foot against an obstruction which apart from the excruciating pain resulting can cause serious injury to this delicate area.

While toe protectors and the like are known, none have been incorporated into an orthopedic shoe for postoperative wear. Toe protectors for safety shoes or for use with orthopedic casts would not be applicable or adaptable for use with the present invention.

SUMMARY OF THE INVENTION

This invention is directed to an orthopedic shoe for postoperative wear, and more particularly to an orthopedic shoe having a protective guard for the distal portion of a foot, especially the toes. Each of the embodiments of this invention includes a shoe with a light weight upper portion and a arigid sole which is adjustably secured about the foot of a patient recovering from surgery or an injury to the forefoot. The orthopedic shoe upper portion provides a forward opening through which the toes extend and which open area is protected by a domical, semi-rigid cover portion of the protective guard which is secured to the rigid sole in spaced relationship to the toes of the patient. Securing the protective guard to the shoe may be accomplished with the use of connection tabs nailed or screwed to the sole. An abutment portion of the guard, comprising a generally horizontal rearward projection of the cover portion, stabilizes the protective guard to maintain the spaced relationship relative to the ends of the toes.

In some corrective surgical procedures involving the forefoot, surgical pins are inserted into the toes for periods of time which extend forwardly of the toes. Herein, additional forward clearance for the forefoot is provided with a spacer means, attachable to the abutment portion and arranged to abut the forward edge of the rigid sole.

The abutment portion does not extend across the full width of the cover portion and accordingly provides a pair of side relief areas to accommodate adapting the protective guard to the contours of various orthopedic shoe sizes as well as enabling the protective guard to be used on either a right or a left shoe.

A second embodiment of protective guard provides an attachment means in which the guard ma be easily installed or removed from an orthopedic shoe. Herein, the protective guard includes a retaining pocket or recess adjacent the abutment portion in which the foreward curved tip of the rigid sole is received. Securing is accomplished with the use of an elastic loop or band encircling the sides and heel of the sole and urging the foreward tip of the sole tightly into the retaining pocket. Preferably, side relief areas are provided to enable the semirigid protective guard to conform to the contours of the rigid soles of various orthopedic shoes.

Added side clearance in the area of the toes may be obtained with the provision of break-away sections which are pre-scored and can easily be removed from the sides of the cover portion as required.

Accordingly, it is a primary object of this invention to provide an orthopedic shoe with a semi-rigid protective guard which provides a hollow safety zone above and around the area of a patient's toes.

It is another object of this invention to provide an orthopedic shoe with a semi-rigid forefoot protective guard for postoperative wear which is readily attachable and detachable.

It is still another object of this invention to provide a forefoot protective guard for an orthopedic shoe which is adaptable for use with a plurality of shoe configurations.

It is yet another object of this invention to provide a forefoot protective guard for an orthopedic shoe which is adapted to provide additional forward and side clearances when required.

Other objects, features and advantages of the invention will be readily apparent from the following description of several embodiments thereof, taken in conjunction with the accompanying drawings although variations and modifications may be affected without departing from the spirit and scope of the novel concepts of the disclosure.

BRIEF DESCRIPTION OF THE DRAWINGS

FIG. 6 is a longitudinal sectional view taken generally along the line VI—VI of FIG. 5;

FIG. 7 is a perspective view of an alternative form of the invention;

FIG. 8 is a fragmentary longitudinal sectional view similar to FIG. 3 but showing the attachment arrangement for the protective guard of FIG. 7; and FIG. 9 is a cross-sectional view taken generally along the line IX—IX of FIG. 8.

DETAILED DESCRIPTION OF THE INVENTION

Figure 1:
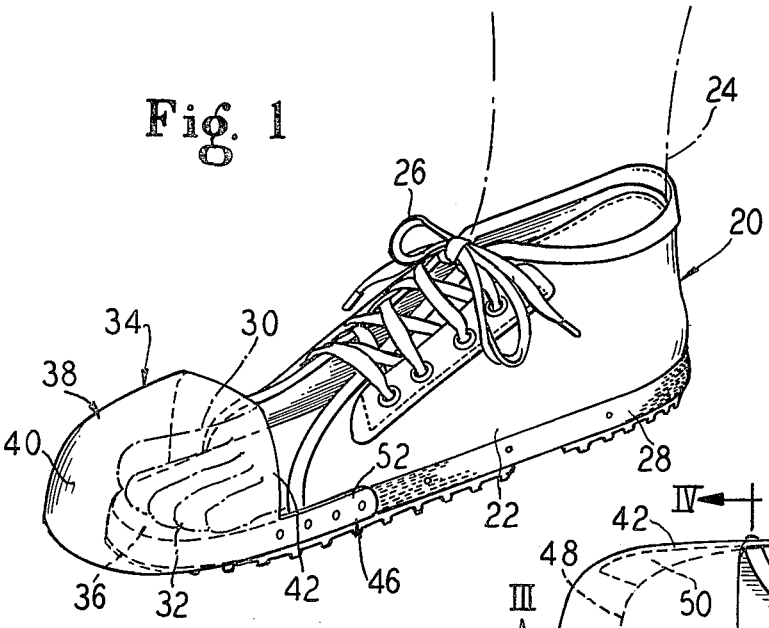
FIG. 1 is a perspective view of an orthopedic shoe having a toe protective guard constructed in accordance with the principals of the present invention.

In the embodiment of the invention illustrated in FIG. 1 of the drawings, 20 generally disignates an orthopedic shoe having a light weight canvas upper portion 22, adapted to be secured about the foot 24 of a patient, having undergone orthopedic surgery or recovering from a forefoot injury, by means of laces 26 or other suitable adjustable securing means. The shoe 20 also includes a rigid sole portion 28, which may be formed from a wooden block and attached to the upper shoe portion 22 by any suitable means. The upper portion 22 is open at its forward end, allowing the forefoot 30 of the patient to extend therethrough as best seen in FIG. 1.

Thus, the patient's toes 32 rest on the rigid sole portion 28 in a relatively exposed position while the laces 26 adjustably secures the upper portion 22 to the patient's foot 24 which may be heavily bandaged. The exposed forefoot 30 is provided with a one-piece protective guard 34 which is secured to a forward end 36 of the rigid sole portion 28. The protective guard 34, which is preferably constructed of a semi-rigid plastic material such as polyethylene of a suitable thickness to absorb bumps and enabling the guard 34 to withstand substantial impacts without appreciable deformation, extends about and above the toes 32 in a generally fixed spaced relationship thereto.

The protective guard 34 includes a domical cover portion 38, having vaulted forward section 40 and arched side sections 42 open to the rear to receive the forefoot 30 of the patient. The guard 34 also includes an abutment portion 44 comprising a generally horizontal projection extending rearwardly from the forward section 40 for abutting engagement with a forward surface 48 of the rigid sole portion 28 to maintain the spaced relationship between the cover portion 38 and the toes 32.

Figure 2:
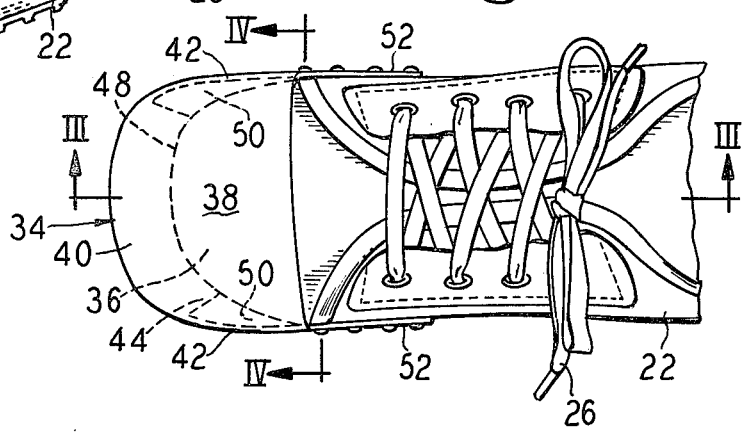
FIG. 2 is a fragmentary top elevational view of the metatarsophalangeal region of orthopedic shoe shown in FIG. 1.
Figure 3:
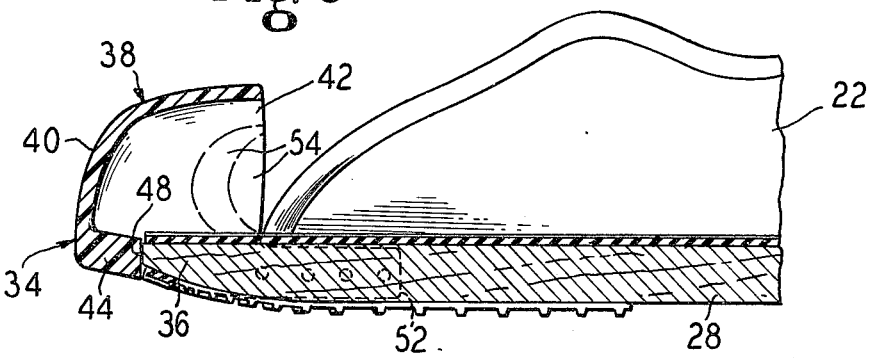
FIG. 3 is a longitudinal sectional view taken generally along the line III—III of FIG. 2.
Figure 4:
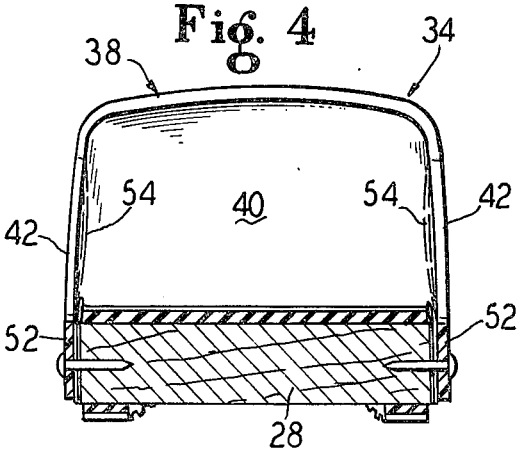
FIG. 4 is a transverse sectional view taken generally along the line IV—IV of FIG. 2.

It will be readily seen in FIG. 2 that the abutment portion 44 does not extend laterally across the full width of the cover portion 38 but only the front central area of the forward section 40 wherein a pair of side relief areas 50 are provided to accommodate adapting the the semi-rigid guard 34 to the contours of various size orthopedic shoe soles 28. Further, these relief areas 50 allow the semi-rigid protective guard 34 to be mounted securely to either a left or right shoe by slightly deforming the cover portion 38 to accommodate nailing or screwing a pair of mounting tabs 52 of a mounting means 46 to the rigid sole 28 in a flat secure manner in conformity with the contours of the sole.

In some instances additional side clearances may be required for proper access or close observation of the anterior portion of the foot 24. Herein, the cover portion 38 is provided with break-away areas 54 which are defined by scoring in the side sections 42 with individual areas easily removable according to need. Further, in other instances additional toe space may be required, as for example to provide forward clearance for surgical pins projecting from the tips of the toes. Herein, a spacer means 55 is interposed between the abutment portion 44 and the forward surface 48 of the rigid sole 28 to accommodate mounting the protective guard 34 in a more advanced position relative to the toes while still providing the bracing support communication with the forward surface 48 of the sole 28.

Figure 5:
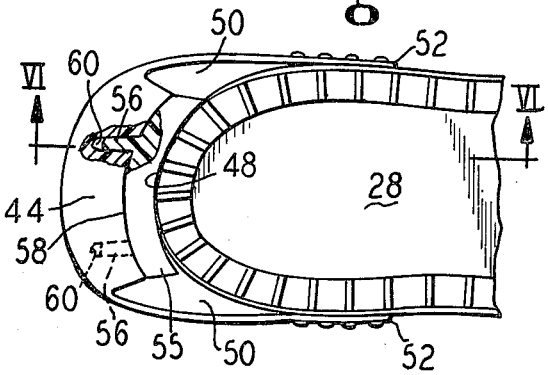
FIG. 5 is a bottom view of the orthopedic shoe shown in FIG. 1 with a spacer means utilized to provide additional forward clearance.

As best seen in FIG. 5 of the drawings a pair of connecting pins 56, extending from a leading edge 58 of the spacer means 55, are seated in a pair of complementary passages 60 formed in the abutment portion 44. Thus it will be seen that the spacer means 55, which is of a suitable spacing thickness to provide the desired additional forward toe clearance, forms an adjustable extension of the abutment portion 44, which of course increases the overall length of the orthopedic shoe 20. Since an extended shoe length may somewhat encumber the walking abilities of a patient, it is generally desirable to remove the spacer means 55 after the need for additional forward clearance has past. Thus, it is possible to mount the protective guard 34 to the orthopedic shoe to provide a suitable clearance for the toes which may be adjusted as the conditions warrant.

Now with specific reference to FIGS. 7 to 9 of the drawings, there is shown a protective guard 70, similar to the guard 34 but which may be readily assembled to or removed from an orthopedic shoe 20. The protective guard 70 includes a domical cover portion 72 which is supported on the rigid sole 28 by an abutment means 74 having an abutting surface 76 which generally conforms to the curvilinear forward surface 48 of the rigid sole 28. Further, upper and lower retaining lips 78, 79 along with the abutting surface 76 define a retaining pocket to receive the forward end 36 of the sole 28. A pair of mounting tabs 80, 81, extending rearwardly from each side of the cover portion 72 provide an attachment for an elastic band 82 which is adapted to encircle sides 84 and a heel portion 86 of the sole 28 to urge the forward end 36 of the sole snuggly into the retaining pocket.

When the protective guard 70 is to be removed from the shoe the elastic band 82 is simply slipped down over the heel portion 86 and the guard can then be pulled free of the forward end 36 of the rigid sole 28 providing quick and easy accessibility to the forefoot 30 of the patient. Preferably relief areas 88 are provided between the abutment portion 74 and the sides of the cover portion 72 in a manner similar to the FIG. 2 embodiment, enabling the protective guard 70 to generally conform to the sole contours of a specific orthopedic shoe upon which the guard is to be installed.

Obviously various other arrangements and modification in the materials and configuration of the forefoot protective guards illustrated or suggested in connection with specific embodiments of my invention, may be made without departing from the spirit and scope of the novel concepts of this invention.

I claim as my invention:

1. An orthopedic shoe for postoperative wear having a generally rigid sole and a light weight upper portion with an open front for the forefoot of a patient to extend therethrough wherein the improvement comprises:

a semi-rigid protective guard for the forefoot including:

a domical cover member having a vaulted forward portion and a pair of side portions defining a hollow safety zone which is adapted to extend about and to overlie the distal portion of a patient's foot in fixed, spaced relationship thereto, a generally horizontal abutment means comprising an abutting end surface, depending from said forward portion and extending rearwardly therefrom into abutting engagement with a forward contoured surface of said rigid sole, and a mounting means extending rearwardly of said cover member for securing said protective guard to said orthopedic shoe in said fixed, spaced relationship relative to the distal portion of said patient's foot.

2. The orthopedic shoe according to claim 1, wherein said domical cover member includes a pair of relief areas interposed between said side portions and said abutment means to accommodate adapting the protective guard to the contours of said rigid sole whereby the protective guard will adapt to a variety of shoe sizes and configurations.

3. The orthopedic shoe according to claim 2, wherein mounting means includes a pair of mounting tabs each of which extend rearwardly from one of said side portions of the cover member and adapted to be fixedly secured to said rigid sole.

4. The orthopedic shoe according to claim 2, wherein mounting means includes a flexible band secured to a pair of mounting tabs each of which extend rearwardly from one of said side portions of the cover member and adapt to encircle a rear portion of said orthopedic shoe to retain the protective guard in said fixed, spaced relationship.

5. The orthopedic shoe according to claim 1, wherein said protective guard further includes a spacer means adapted to be connected to said abutment means to provide an abutting extension whereby the guard may be secured to the rigid sole of said orthopedic shoe in an advanced position.

6. An orthopedic shoe for postoperative wear having a generally rigid sole and a light weight upper portion with an open front for the forefoot of a patient to extend therethrough wherein the improvement comprises:

a semi-rigid protective guard for the forefoot including:

a domical cover member having a vaulted forward portion and a pair of side portions defining a hollow safety zone which is adapted to extend about and to overlie the distal portion of a patient's foot in fixed, spaced relationship thereto, said domical cover member includes a pair of relief areas interposed between said side portions and said abutment means to accommodate adapting the protective guard to the contours of said rigid sole whereby the protective guard will adapt to a variety of shoe sizes and configurations, a generally horizontal abutment means, depending from said forward portion and extending rearwardly therefrom into abutting engagement with a forward contoured surface of said rigid sole, and a mounting means extending rearwardly of said cover member for securing said protective guard to said orthopedic shoe in said fixed, spaced relationship relative to the distal portion of said patient's foot, said mounting means includes a flexible band secured to a pair of mounting tabs each of which extend rearwardly from one of said side portions of the cover member and adapt to encircle a rear portion of said orthopedic shoe to retain the protective guard in said fixed, spaced relationship, and said abutment means includes a curved abutting surface with spaced upper and lower retaining lips associated therewith to define a retaining pocket for receiving a forward portion of said rigid sole and said flexible band comprises an elastic loop to urge the forward portion of said rigid sole into said retaining pocket.

7. An orthopedic shoe for postoperative wear having a generally rigid sole and a light weight upper portion with an open front for the forefoot of a patient to extend therethrough wherein the improvement comprises:

a semi-rigid protective guard for the forefoot including:

a domical cover member having a vaulted forward portion and a pair of side portions defining a hollow safetly zone which is adapted to extend about and to overlie the distal portion of a patient's foot in fixed, spaced relationship thereto, the side portions of said cover member are provided with break-away areas which when removed provide additional side clearance for the foot, a generally horizontal abutment means, depending from said forward portion and extending rearwardly therefrom into abutting engagement with a forward contoured surface of said rigid sole, and a mounting means extending rearwardly of said cover member for securing said protective guard to said orthopedic shoe in said fixed, spaced relationship relative to the distal portion of said patient's foot.

8. A semi-rigid protective guard for use with orthopedic shoes to provide a hollow safety zone, for the toes of the wearer including:

a cover member having a forward portion, and a pair of side portions defining a hollow safety zone which is adapted to extend about and to overlie the distal portion of a patient's foot in spaced relationship thereto, a generally horizontal abutment means comprising an abutting end surface depending from said forward portion and extending rearwardly for abutting engagement with a forward rigid sole portion of an orthopedic shoe, a mounting means associated with the cover member and adapted to be fixedly secured to an orthopedic shoe whereby the protective guard is maintained in fixed, spaced relationship relative to a patient's toes, and a pair of spaced relief areas interposed between said abutment means and each of said side portions to accommodate mounting said protective guard to an orthopedic shoe.

9. The protective guard according to claim 8, whereby mounting means includes a mounting pocket to receive a forward rigid sole portion of an orthopedic shoe and an elastic band adapted to encircle the shoe to urge a forward sole portion into said pocket.

10. A semi-rigid protective guard for use with orthopedic shoes to provide a hollow safety zone, for the toes of the wearer including:

a cover member having a forward portion, and a pair of side portions defining a hollow safety zone which is adapted to extend about and to overlie the distal portion of a patient's foot in spaced relationship thereto, a generally horizontal abutment means depending from said forward portion and extending rearwardly for abutting engagement with a forward rigid sole portion of an orthopedic shoe, said abutment means includes a spacer extension to provide additional forward clearance for a patient's toes and wherein side portions of said cover member are provided with break-away areas which when removed provide additional side clearance for a patient's toes, a mounting means associated with the cover member and adapted to be fixedly secured to an orthopedic shoe whereby the protective guard is maintained in fixed, spaced relationship relative to a patient's toes, and a pair of spaced relief areas interposed between said abutment means and each of said side portions to accommodate mounting said protective guard to an orthopedic shoe.

* * * * *